US008250827B2

(12) United States Patent
Lin et al.

(10) Patent No.: US 8,250,827 B2
(45) Date of Patent: Aug. 28, 2012

(54) HANGER WITH GRIPPING TABS

(75) Inventors: Jin-Jie Lin, Livermore, CA (US); Thomas G. Evans, Dublin, CA (US); Tawn Simons, Brentwood, CA (US); Caleb Knudson, Pleasanton, CA (US); Paul Oellerich, Hayward, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 785 days.

(21) Appl. No.: 11/475,522

(22) Filed: Jun. 26, 2006

(65) Prior Publication Data

US 2007/0294979 A1 Dec. 27, 2007

(51) Int. Cl.
*E04B 1/38* (2006.01)

(52) U.S. Cl. ..... 52/702; 52/289; 52/699

(58) Field of Classification Search ..... 52/702, 52/289, 699, 712, 715; 403/232.1
See application file for complete search history.

(56) References Cited

U.S. PATENT DOCUMENTS

| | | | | |
|---|---|---|---|---|
| 478,163 | A | 7/1892 | Lehman | |
| 508,280 | A | 11/1893 | Cavallaro | |
| 546,147 | A | 9/1895 | Gregg | |
| 770,050 | A | 9/1904 | Dreyer | |
| 783,807 | A | 2/1905 | Tuteur | |
| 832,133 | A | 10/1906 | Lanz | |
| 1,720,104 | A | 7/1929 | Taylor | |
| 2,500,636 | A | 3/1950 | Isakson | |
| 3,036,347 | A | 5/1962 | Findleton | |
| 3,222,831 | A | 12/1965 | Pritchard | |
| 3,332,188 | A | 7/1967 | Schaefer | |
| 3,365,222 | A * | 1/1968 | Polyak | 403/384 |
| 3,601,428 | A * | 8/1971 | Gilb | 403/232.1 |
| 3,633,950 | A * | 1/1972 | Gilb | 403/384 |
| 3,703,304 | A * | 11/1972 | Losee | 411/462 |
| 3,752,512 | A * | 8/1973 | Gilb | 403/190 |

(Continued)

FOREIGN PATENT DOCUMENTS

DE 296 10 381 9/1996

(Continued)

OTHER PUBLICATIONS

KANT-SAG Lumber Connectors Catalog "Hardware for SWII-Joists and LVL Composite Wood"; estimated publication 1995, 8 pages.

(Continued)

*Primary Examiner* — William Gilbert
*Assistant Examiner* — James Buckle, Jr.
(74) *Attorney, Agent, or Firm* — James R. Cypher; Charles R. Cypher

(57) ABSTRACT

A joist hanger used to attach a joist to a support member or header designed to minimize the noise caused by the rubbing of the members of the connection, during loading. The joist hanger includes a seat and a pair of side walls extending upwardly in spaced relationship therefrom to receive the end portion of an joist. The bottom of the joist rests on the seat, and the side faces of the joist extend upwardly therefrom in spaced relationship from the side walls of the hanger. Inwardly projecting guides formed in the side walls of the hanger, hold the joist at selected points, maintaining the spaced relationship between the sides walls of the hanger and the side faces of the joist. The inwardly projecting guides can be formed with embossed portions connected to the side walls of the joist. The joist hanger is also formed with back flanges and top flanges that are relatively narrow compared to the back flanges.

13 Claims, 13 Drawing Sheets

U.S. PATENT DOCUMENTS

| | | | | | |
|---|---|---|---|---|---|
| 4,005,942 | A | * | 2/1977 | Gilb | 403/189 |
| 4,198,175 | A | | 4/1980 | Knepp et al. | |
| 4,291,996 | A | * | 9/1981 | Gilb | 403/14 |
| 4,343,580 | A | | 8/1982 | Moyer | |
| 4,408,262 | A | | 10/1983 | Kusmer | |
| 4,411,548 | A | * | 10/1983 | Tschan | 403/232.1 |
| 4,423,977 | A | | 1/1984 | Gilb | |
| 4,480,941 | A | * | 11/1984 | Gilb et al. | 403/232.1 |
| 4,569,451 | A | | 2/1986 | Parrott | |
| 4,576,280 | A | | 3/1986 | Dove | |
| 4,594,017 | A | | 6/1986 | Hills | |
| 4,802,786 | A | | 2/1989 | Yauger et al. | |
| 4,854,096 | A | | 8/1989 | Smolik | |
| 4,893,961 | A | | 1/1990 | O'Sullivan | |
| 4,920,725 | A | | 5/1990 | Gore | |
| 5,104,252 | A | | 4/1992 | Colonias | |
| 5,203,132 | A | | 4/1993 | Smolik | |
| 5,217,317 | A | | 6/1993 | Young | |
| 5,297,886 | A | | 3/1994 | Jansen | |
| 5,367,853 | A | | 11/1994 | Bryan | |
| 5,394,665 | A | | 3/1995 | Johnson | |
| 5,555,694 | A | * | 9/1996 | Commins | 52/702 |
| 5,560,156 | A | | 10/1996 | McDonald | |
| 5,564,248 | A | * | 10/1996 | Callies | 52/702 |
| 5,603,580 | A | * | 2/1997 | Leek et al. | 403/232.1 |
| 5,930,968 | A | | 8/1999 | Pullam | |
| 6,012,262 | A | | 1/2000 | Irving | |
| 6,112,495 | A | | 9/2000 | Gregg | |
| 6,523,321 | B1 | * | 2/2003 | Leek et al. | 52/702 |
| 6,877,291 | B2 | * | 4/2005 | Shamroukh et al. | 52/702 |
| 7,065,932 | B2 | * | 6/2006 | Roesset et al. | 52/712 |
| 7,334,372 | B2 | * | 2/2008 | Evans et al. | 52/289 |
| 2001/0010167 | A1 | * | 8/2001 | Leek | 72/379.2 |
| 2002/0043040 | A1 | * | 4/2002 | Cherry et al. | 52/702 |
| 2002/0078656 | A1 | * | 6/2002 | Leek et al. | 52/702 |
| 2003/0009980 | A1 | * | 1/2003 | Shahnazarian | 52/712 |
| 2004/0244328 | A1 | * | 12/2004 | Bak et al. | 52/712 |
| 2006/0059845 | A1 | * | 3/2006 | Visone | 52/702 |
| 2006/0081743 | A1 | * | 4/2006 | Evans et al. | 248/226.11 |
| 2006/0191233 | A1 | * | 8/2006 | Tamlyn | 52/702 |

FOREIGN PATENT DOCUMENTS

| | | |
|---|---|---|
| DE | 195 48 334 | 6/1997 |
| EP | 0 745 735 A | 12/1996 |

OTHER PUBLICATIONS

Simpson Strong-Tie Co., Inc. Catalog C-CWP98; published 1998, pp. 8, 9.

Journal of Light Construction; published Mar. 1998; p. 52.

Council of American Building Officials Report No. NER-209; published Jul. 1991; 4 pages.

Council of American Building Officials Report No. NER-469; published Aug. 19921; pp. 1, 2, 11, 12.

Simpson Strong-Tie Co., Inc. Catalog 79H-1; published 1979; 3 pages.

KANT-SAG Lumber Connectors "Seat Cleat" brochure; estimated publication 1995; 1 page.

Simpson Strong-Tie Co., Inc. Catalog C-97; published 1997; p. 46.

Simpson Strong-Tie Co., Inc. Catalog C-98, Wood Construction Connectors, Published 1997, Cover and p. 14.

Simpson Strong-Tie Co., Inc. Catalog C-2003; published Jan. 1, 2003, p. 66.

* cited by examiner

SST/1517

Replacement Sheet

10/13

HANGER WITH GRIPPING TABS

FIELD OF THE INVENTION

The present invention relates to building construction, and more particularly to a joist hanger adapted to secure a joist to a header or other support member while minimizing the contact between the surfaces of the hanger and the surface of the joist so as to reduce the likelihood that portions of the hanger will rub against the joist during loading, causing unwanted squeaks.

BACKGROUND

Joist hangers are used in building construction to secure the ends of joists or other members to headers or other support members. Typically, the joist hanger includes a u-shaped portion that receives the joist. The bottom surface of the joist rests on the seat of the hanger, and the side walls of the hanger are dimensioned to closely receive the side faces of the joist, providing it with lateral support.

Where appropriate, the joist may be connected to the hanger by means of nails driven through the side walls into the side faces of the joist. These nails may simply be driven horizontally into the joist, in which case they are preferably very short nails that will not pass through the joist. Alternatively, longer nails may be used that are driven horizontally and angularly into the joist such that they are driven into the header as well. This is often referred to as toe-nailing. The other common way to nail the hanger to the joist is to use short nails that are driven downward at an angle into only the joist.

Often, in order to connect the joist hanger to the header, back flanges are attached to the side walls. Generally, these flanges extend laterally from the side walls to overlap a portion of the face of the header. These flanges can extend inwardly or outwardly from the side walls, depending on design considerations.

Openings may be provided in the back flanges to receive fasteners. These fasteners are generally nails in light-frame wood construction. Screws and bolts are also used in wood construction, depending on the size of the members to be joined and other considerations. In light-gauge steel construction, sheet metal screws, bolts and rivets are commonly used.

In perhaps the simplest of hangers, the back flanges extend outwardly from the side flanges, providing an easily accessed fastening face. Fasteners are then driven through the back flanges into the header. In other instances, design considerations dictate which particular attachment method is used for attaching the joist and the hanger to the header.

In addition, top flanges may be attached to the back flanges to aid in the attachment to the header. If top flanges are used, the hanger is generally called a top-flange hanger. If no such top flanges are used, the hanger is generally called a face-mount hanger. If the top flanges wrap over the top of the header and down to the opposite face of the header the hanger is often called a wrap-around hanger. Again, various design considerations dictate what type of hanger and whether a top flange is used. Generally, if a top flange is used and the header is made of wood, pre-formed holes will be made in the top flange to receive suitable fasteners for connecting the top flange to the header.

As mentioned above, it is often desirable to connect the joist to the hanger. This is generally done to resist uplift forces on the joist. Such forces are often due to lateral loading on the building due to high winds or an earthquake. Also, one end of a joist must be downwardly restrained if that joist is cantilevered, for example, to support an overhanging deck. As mentioned above, to retain the joist within a conventional hanger, holes may be provided in the hanger side walls, through which nails are driven into the joist.

Using nails or screws to fix the joist to the hanger to resist uplift forces may be satisfactory when the joist is constructed from solid-sawn lumber or light gauge steel, but I-Joists are much more difficult to connect to a hanger with nails without splitting or damaging the chords of the I-Joist.

I-Joists have become more and more attractive as building materials as the cost of wood products has increased, because they generally use a third less lumber to provide similar performance as their solid-sawn counterparts, which generally makes them less expensive. Thus, the need has arisen to adequately address the problems of securing I-Joists against uplift.

Most sheet metal hangers designed to attach wood I-Joist members to a support member use one of three methods to resist uplift forces on the I-Joist. In the first method, two short joist nails are driven through the sides of the hanger into the bottom chord of the I-joist at a downward angle. It is especially important to put the nails in at a downward angle when using a laminated veneer I-Joist to prevent splitting of the bottom chord. In the second method, web stiffeners are attached to the web of the I-joist, and nails are driven into the web stiffeners. The joist can also be toe-nailed through the web stiffeners into the header for even greater uplift resistance. In the third method, prongs or tabs are bent inwardly from the side walls of the hanger seat and they either engage the top surface of the I-joist to hold it down or dig into the sides of the joist, if it lifts off the seat. Additional fasteners may or may not be used with methods that use tabs.

All of these methods have shortcomings. As mentioned above, any method that uses nails to connect the bottom chord to the hanger requires careful placement of the nails to prevent splitting of the bottom chord.

Furthermore, any method that uses nails must rely on the builder to go through the added step of actually installing the nails or using all the required nails, which can be time consuming and is sometimes ignored. Missing joist nails are difficult to detect through inspection because of their placement. Without joist nails, the bottom chord of the wood I-Joist is not properly secured for uplift capacity and can also be a source of floor squeaks.

Adding web stiffeners and then nailing or toe-nailing into the web stiffeners is time-consuming and material-intensive.

A number of different methods have been proposed for securing an I-Joist in a hanger against uplift forces that use tabs. A good overview of these methods is provided in U.S. Pat. No. 4,411,548, granted to J. Donald Tschan on Oct. 25, 1983 and also U.S. Pat. No. 5,564,248, granted to Gerald Callies on Oct. 15, 1996.

Most of the methods that rely on tabs or prongs to hold the joist down do not rely on the tabs alone, but use nails as well, raising all the problems that accompany nails. The first method that used a tab, and did not use nails, is taught by U.S. Pat. No. 4,411,548, and does not appear to have gained market acceptance. The second method is taught by U.S. Pat. No. 6,523,321 and is commercially available as Simpson Strong-Tie's IUS I-joist hanger.

The present invention, when used with an I-Joist, provides uplift resistance without using nails to secure the I-Joist to the hanger.

While a number of different methods have been proposed for resisting uplift of joists in light frame construction, up until now little has been done to address the generation of unnecessary noise due to the rubbing between the different parts of the connection as they loosen, which usually happens as the building settles and ages. This unnecessary and unwanted noise due to looseness of the parts is commonly referred to, and experienced, as "floor squeak."

Among the prior art methods of securing a joist to a hanger, U.S. Pat. No. 5,564,248, granted to Gerald Callies, is probably the patent most concerned with addressing floor squeak. In his patent, Callies recognized that floor squeak can develop when the connection of the members making up the connection is loose. Callies '248 recognized that it is important to keep the bottom of the chord resting on the seat of the hanger to minimize floor squeak. To help keep the bottom of the I-Joist on the seat of the hanger, Callies '248 proposed that a downwardly, and inwardly projecting tab be formed in each side wall of the hanger that would bite into the side faces of the joist, and resist movement of the joist off of the seat of the hanger. It appears that Callies '248 did not mean for this tab to provide design load uplift resistance for the joist in most situations, but rather for nails to be used to provide design load uplift resistance, and for the tabs to prevent any uplift of the joist that might occur during the installation of the nails through the hanger and into the joist. Despite its concern with floor squeak, Callies '248 is silent about preventing floor squeak, except for statements about keeping the joist on the seat.

In addition to identifying noise problems associated with the joist lifting off of the seat of the hanger, the inventors have also found that it is important to keep the side walls spaced away from the hanger as much as possible, and to minimize any portions of the hanger that would lie between the top surface of the header and the sub-flooring.

The connection of the present invention improves on the prior art, and in particular that of Callies '248 and Tschan '548, by providing members which not only hold an I-Joist down onto the seat of the hanger without any additional operations having to be performed by the installer during the formation of the connection, but also push the joist away from the sides of the hanger while grabbing it firmly. Thus, in the present invention there is less contact between the joist and the hanger, so that less noise can be generated by the rubbing of the two parts should any looseness develop. Further, the two pieces are firmly held against each other, so that it is less likely for any looseness to develop.

SUMMARY OF THE INVENTION

It is a goal of the present invention to eliminate the need to use nails or other fasteners to sufficiently attach an I-Joist to a hanger to provide design load uplift resistance in selected applications.

It is a further goal of the present invention to support a joist from a header by means of a hanger, the hanger being especially formed to work with selected joists to reduce the noises or squeaks that can develop during loading of this connection.

The preferred embodiment of the present invention relates to a joist hanger which not only makes possible quick and convenient attachment of an I-Joist to a header, but also prevents uplift of the I-joist and reduces floor squeak attributable to the connection of the I-Joist to the header by means of the hanger.

The joist hanger of the present invention includes a seat for receiving the bottom of the joist and side walls on either side of the seat, extending upwardly therefrom for receiving the end portion of a joist.

Preferably, the joist hanger also has one or more back flanges connected to the side walls that overlap the header face to which the hanger will be attached.

An improvement embodied in the present invention includes specially formed inwardly projecting guides that are part of the side walls.

Preferably, the inwardly projecting guides in the side walls can hold the joist away from the side walls, and can also hold I-Joists down on the seat under selected uplift loads without additional fasteners having to be used that mechanically connect the joist to the hanger.

Another improvement of the present invention is to provide the inwardly projecting guides of the side walls with embossed portions that are, at least in part, connected to the side walls of the hanger on at least two sides of the embossment.

Another improvement of the present invention is to form the inwardly projecting guides so that they have an angled surface above the point where they extend inwardly the farthest so that it is fairly easy to install an I-Joist.

Another improvement of the present invention is to form the inwardly projecting guides as sufficiently rigid members such that when they are pushed upon by the sides of an I-Joist during installation, they will cause the side walls of the joist hanger to flex outwardly, allowing the bottom chord of the I-Joist to pass by the guides.

The present invention also incorporates the method by which an I-Joist is installed in a joist hanger having rigid inwardly projecting guides.

Another improvement of the present invention is to form the seat so that it is relatively wider than a selected joist bottom surface which it is to receive, and to form the side walls so that they lie a minimum selected distance from each other at any point. That distance is wider than the end portion of the selected joist which is to be received by the side walls.

Further improvements to standard joist hangers embodied in the present invention include forming a rigid projection in the seat of the hanger that can embed itself into the bottom surface of the joist when sufficient downward force is placed on the joist to push it into the hanger past the projections in the side walls.

A further feature of the present invention includes forming one or more embossments that run from one side wall through the seat and to the other side wall to provide further rigidity to the seat and side walls.

Another improvement embodied in the present invention is providing the back flanges with top flanges that can be used to locate the joist hanger on the header at the proper height while minimally interfering with the attachment of the sub-flooring or other members to the top surface of the header.

Another improvement embodied in the present invention is the formation of upper, outwardly bending tabs on the side walls that guide the joist between the side walls.

DESCRIPTION OF THE PREFERRED EMBODIMENT

Figure 6:
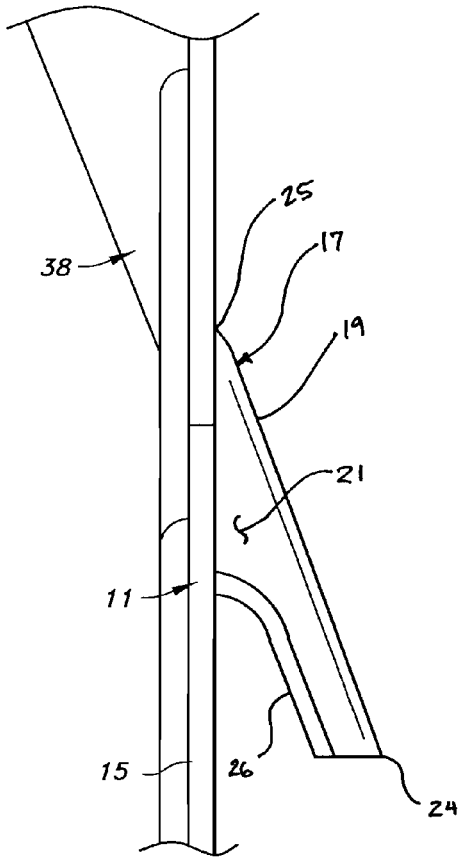
FIG. 6 is an enlarged side elevation view of the side wall of the hanger taken along line 6-6 of FIG. 1, showing one embodiment of the inwardly projecting guide of the present invention.
Figure 5:
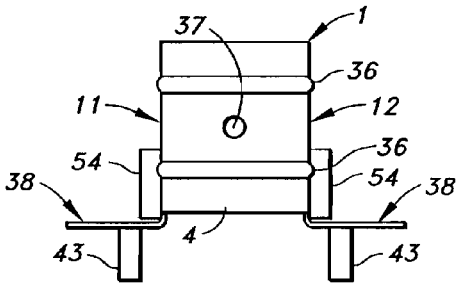
FIG. 5 is a bottom view of the joist hanger of FIG. 2A, taken along line 5-5.
Figure 7:
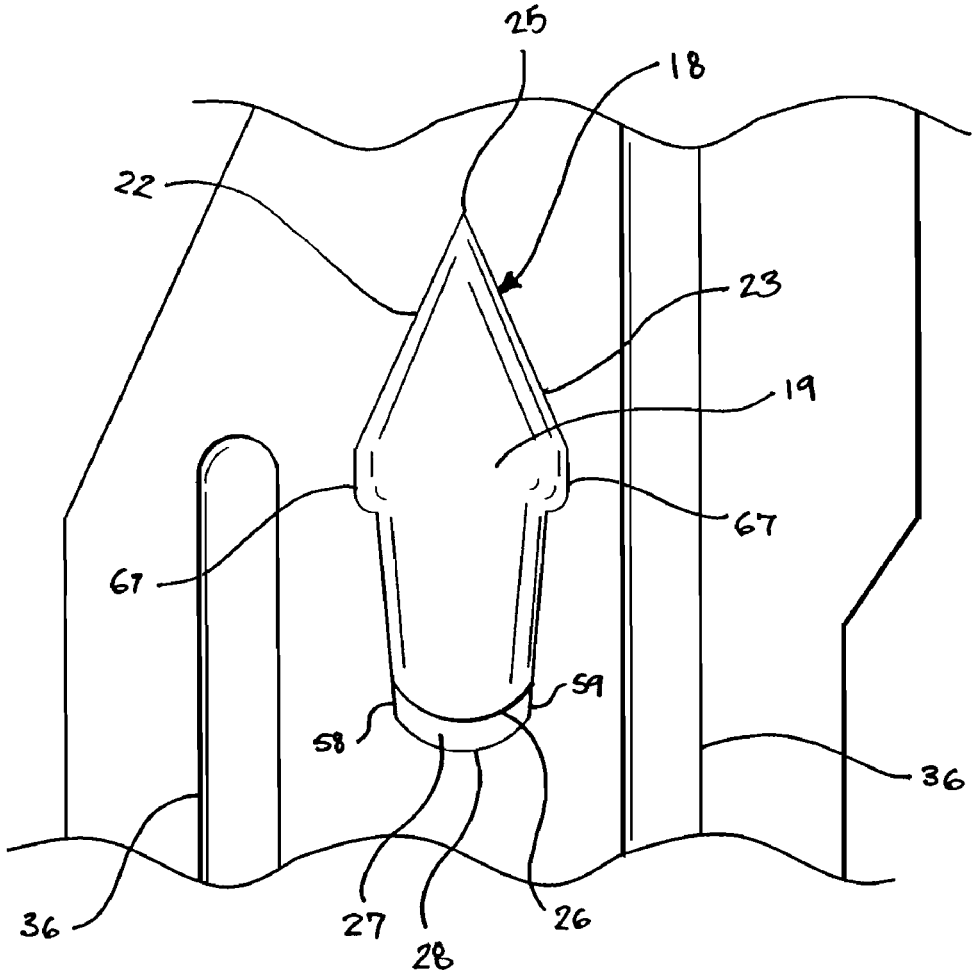
FIG. 7 is an enlarged front elevation view taken along line 7-7 of FIG. 1, showing one embodiment of the inwardly projecting guide of the present invention.

As shown in FIG. 6, the present invention relates to a joist hanger 1 that attaches an I-Joist 2 or other member to a support member or header 3.

The joist hanger 1 has a seat 4 for receiving a portion of the bottom surface 5 of the I-Joist 2. The I-Joist 2 is made up of top and bottom chords 6 and 7 and a web 8 between them. The bottom chord 6 has a bottom surface 5, a top surface 9 and side walls 10.

Figure 1:
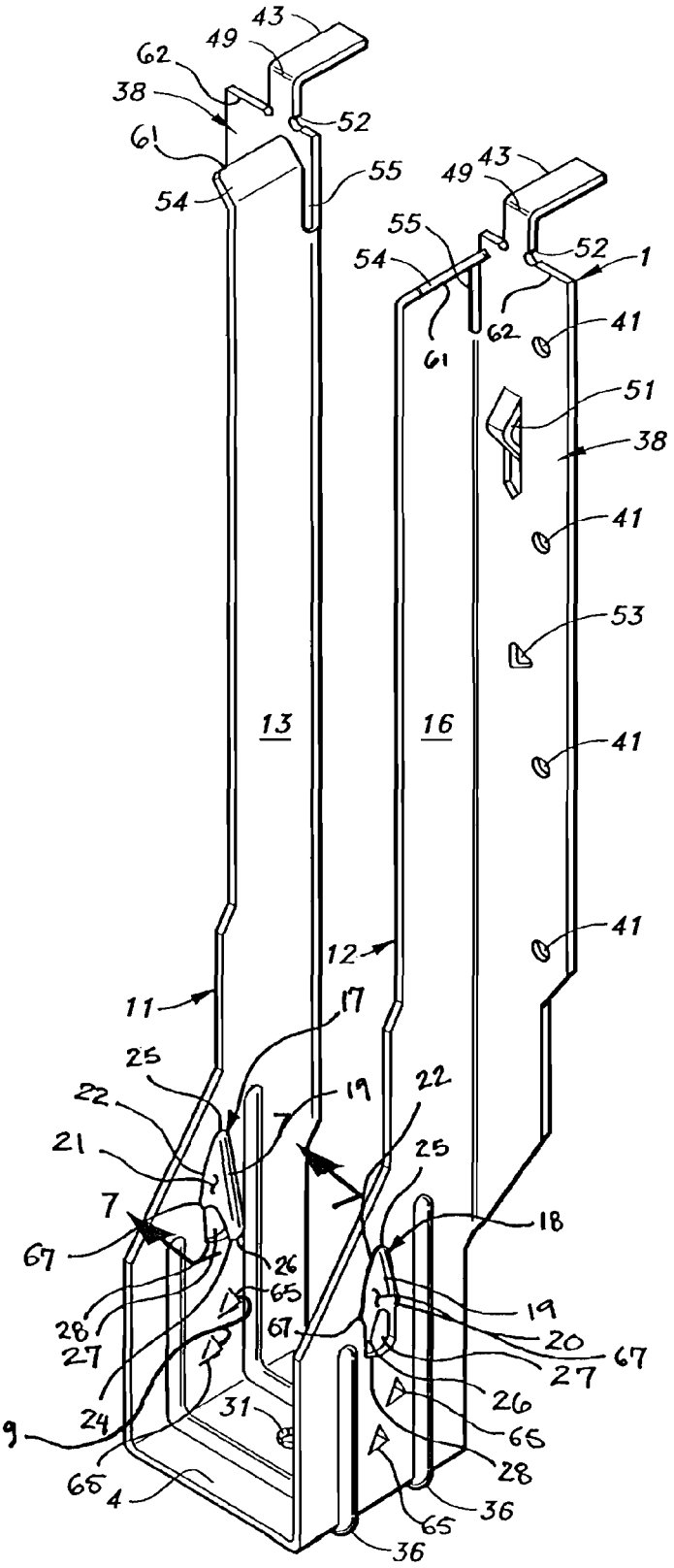
FIG. 1 is an isometric view of a joist hanger of the present invention.

As shown in FIG. 1, the joist hanger 1 is also made with first and second opposed side walls 11 and 12, each of the side walls 11 or 12 being attached to the seat 4, and each of the side walls 11 or 12 having an inwardly facing side surface 13 or 14 and an outwardly facing side surface 15 or 16 with the inwardly facing side surfaces 13 and 14 facing each other.

Figure 2A:
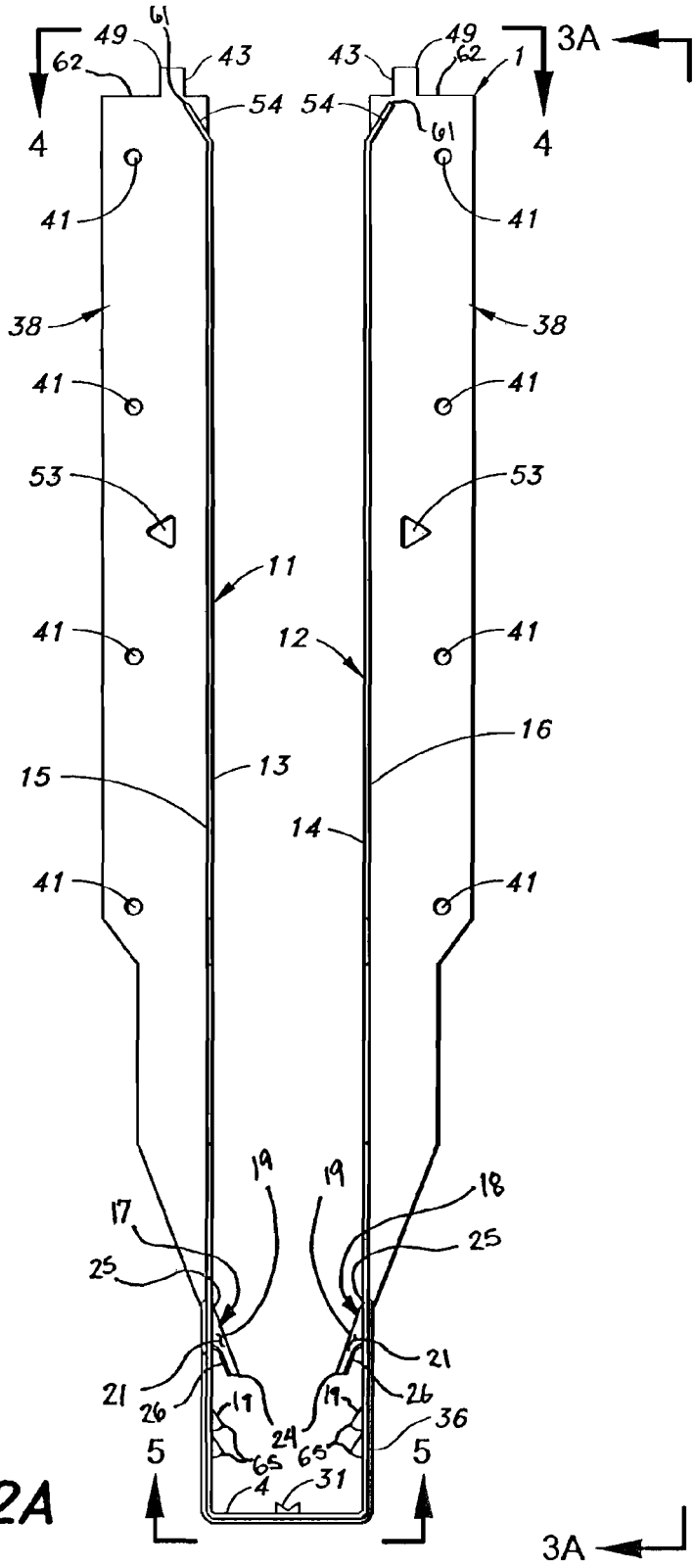
FIG. 2A is a front view of a joist hanger of the present invention.

As shown in FIG. 2A, each of the side walls 11 or 12 also has one or more inwardly projecting guides 17 or 18 projecting inwardly towards the other opposed side wall 11 or 12.

Figure 2B:
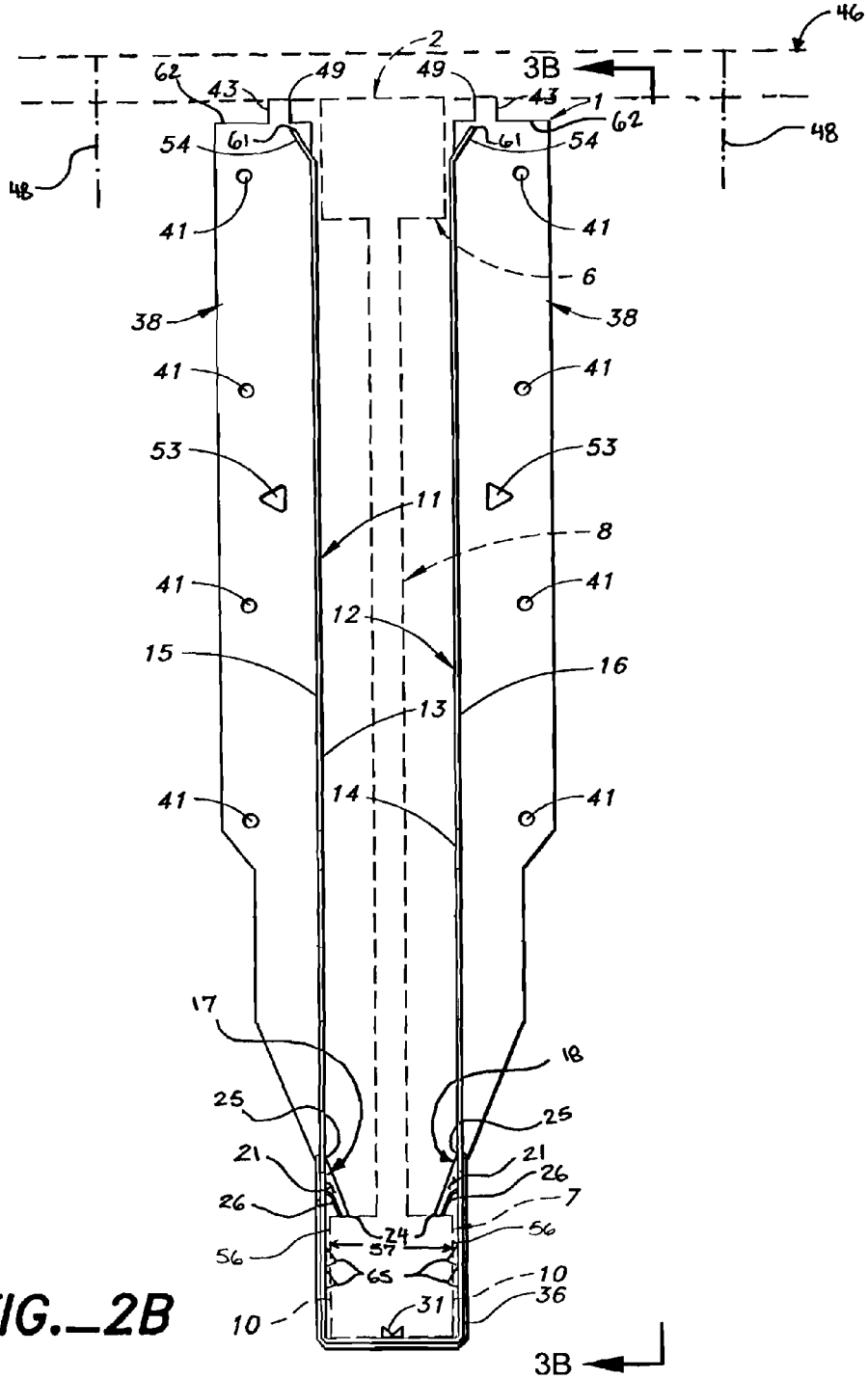
FIG. 2B is a front view of a joist hanger of the present invention. An I-Joist, shown in phantom lines, is received by the joist hanger

As shown in FIG. 2B, in the preferred embodiment the side walls 11 and 12 of the joist hanger 1 are formed with one or more inwardly projecting guides 17 and 18 that hold the I-Joist 2 away from the side walls 11 and 12 of the joist hanger 1. As also shown in FIG. 2B, when formed in a particular manner, the inwardly projecting guides 17 and 18 that hold the I-Joist 2 away from the side walls 11 and 12 can also serve to keep the I-Joist 2 pressed on the seat 4 of the joist hanger 1.

Preferably, only one such inwardly projecting guide 17 or 18 is formed in each side wall 11 or 12. Preferably, the joist hanger 1 is designed to be used with an I-Joist 2 and the inwardly projecting guides 17 and 18 both hold the I-Joist 2 away from the side walls 11 and 12 and down on the seat 4, without the use of additional fasteners, as shown in FIG. 2B.

As can be seen in FIG. 1, in the preferred embodiment the inwardly projecting guides 17 and 18 are formed from the side walls 11 and 12 of the joist hanger 1. Each side wall 11 or 12 has an inwardly facing side 13 or 14 and an outwardly facing side 15 or 16. The seat 4 and the inwardly projecting guides 17 and 18 are disposed on the inwardly facing side 13 or 14 of each side wall 11 or 12. In the preferred embodiment, the creation of the inwardly projecting guides 17 and 18 divides each side wall 11 or 12 into inwardly projecting guides 17 or 18 and a remaining body portion. The inwardly projecting guides 17 and 18 lie closer to the opposite side wall 11 or 12 than the body of the side wall 11 or 12 in which they are formed.

As shown in FIG. 1, the inwardly projecting guides 17 and 18 can have embossments 19 or arched portions, wherein the concave side 20 of the embossment 19 is disposed on the outwardly facing side 15 or 16 of the side wall 11 or 12 and a convex side 21 is disposed on the inwardly facing side 13 or 14 of the side wall 11 or 12.

Figure 3A:
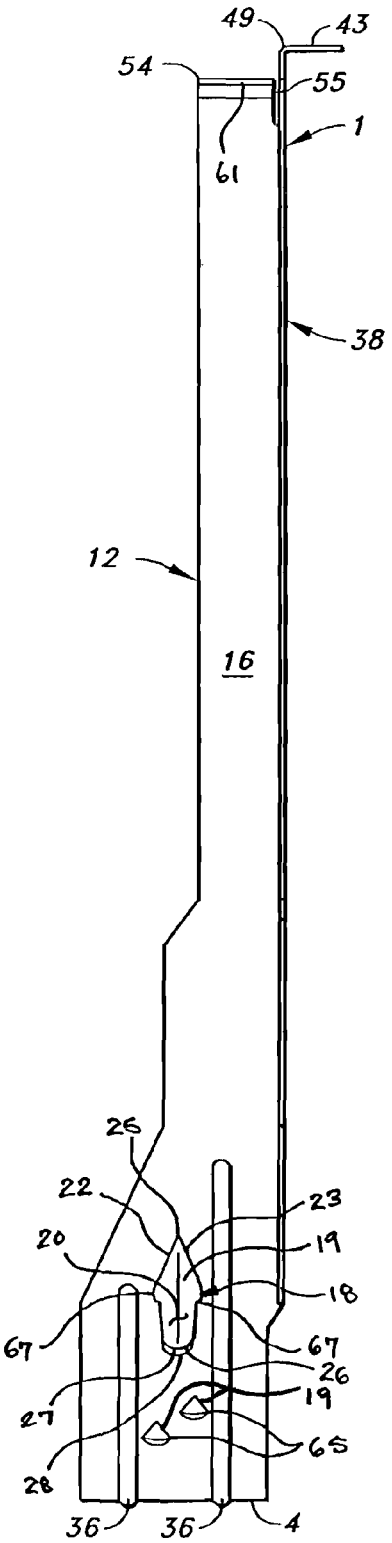
FIG. 3A is a side view of the joist hanger of FIG. 2A, taken along line 3A-3A.
Figure 3B:
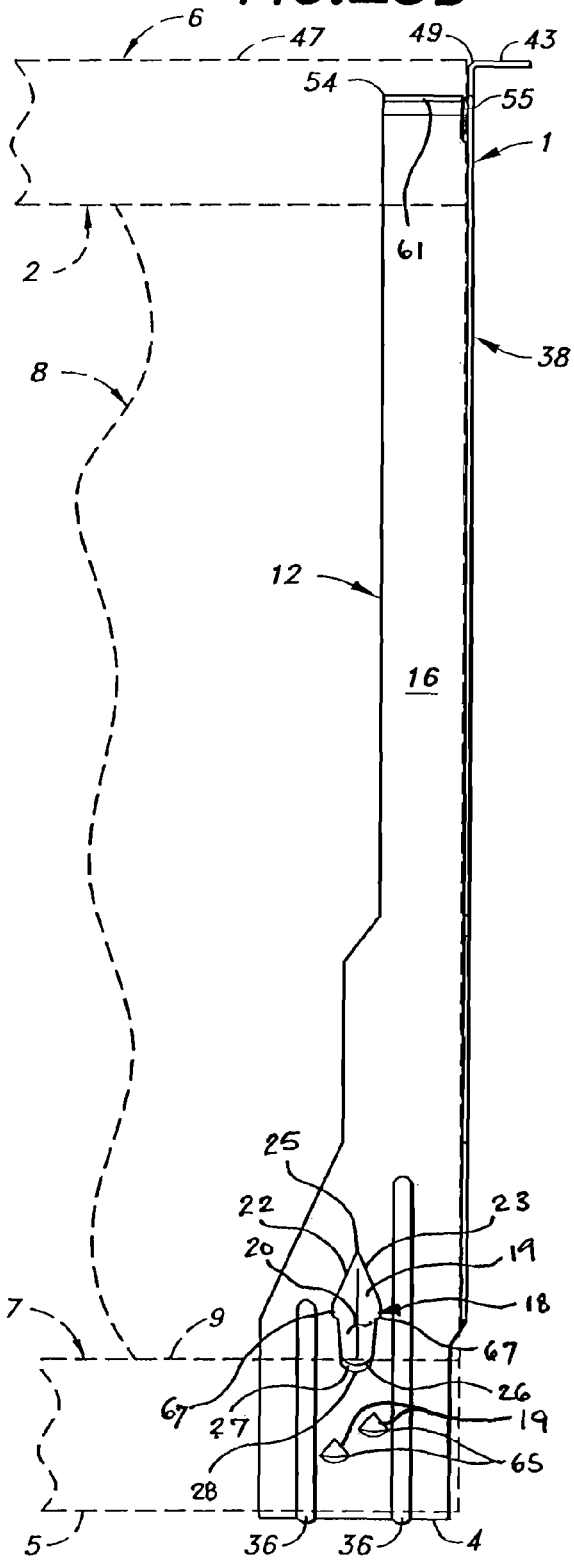
FIG. 3B is a side view of the joist hanger of FIG. 2B, taken along line 3B-3B.
Figure 4:
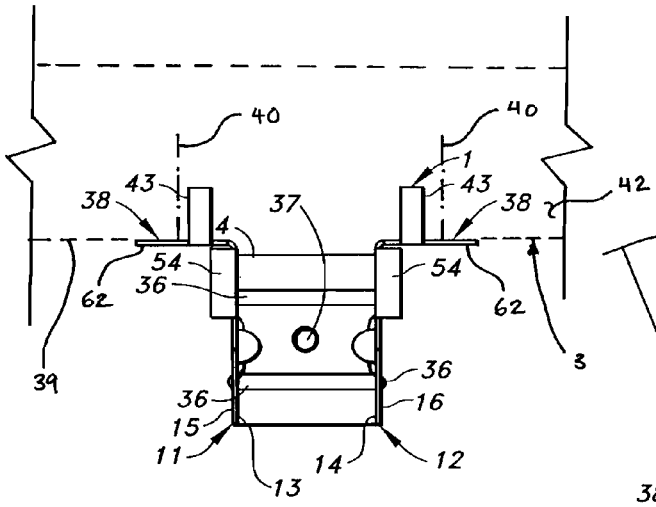
FIG. 4 is a top view of the joist hanger of FIG. 2A, taken along line 4-4.

As best shown in FIGS. 3A and 3B, the embossed portions 19 in the guides 17 and 18 have first and second bracketing transition areas 22 and 23 where at least a portion of the embossment 19 is joined to the side wall 11 or 12. These bracketing transition areas 22 and 23 may lie substantially parallel to each other or may lie in an angular relation and could meet at a point. In the preferred embodiment, the embossment 19 that makes up all of the inwardly projecting guide 17 or 18 can be said to start at one bracketing transition area 22 where it rises out of the side wall 11 or 12 and ends at the other bracketing transition area 23 where it returns to the side wall 11 or 12.

As shown in FIGS. 2A and 2B, in the preferred embodiment each inwardly projecting guide 17 or 18 has a point 24 where the inwardly projecting guide 17 or 18 is farthest away from the side wall 11 or 12 of which it is a part. Each inwardly projecting guide 17 or 18 further has a portion above that point 24 on the inwardly projecting guide 17 or 18 that does not extend as far away from the side wall 11 or 12 as that point 24, such that the inwardly projecting guide tapers towards that point 24 from above that point 24.

As best shown in FIGS. 1 and 6, the inwardly projecting guides 17 and 18 that hold the I-Joist 2 or other member away from the side walls 11 and 12 of the joist hanger 1 can take more than one form.

In a first form shown in FIG. 1, each inwardly projecting guide 17 or 18 is formed as a flared embossment 19 that tapers from its base 26 to its tip 25. This first form is made by cutting a crescent-shaped opening 27 in each side wall 11 and 12 of the joist hanger 1. A generally triangular-shaped portion of each side wall 11 or 12 above the opening 27 is then pushed inward toward the opposite side wall 11 or 12 to form a cone that bulges outward near its base 26, just above the opening 27. This forms two protrusions 67 on either side of the embossment 19.

Flaring the embossment in this manner makes a stronger and stiffer inwardly projecting guide 17 or 18.

As shown in FIG. 2B, in the preferred form used with an I-Joist 2, the opening 27 occurs at or above the level of the top surface 9 of the bottom chord 7 of the I-Joist 2. In the preferred embodiment, the opening 27 in the inwardly projecting guide 17 or 18 also lies at or above the point 24 farthest away from the side wall 11 or 12 of which it is a part. Preferably, the opening or slit 27 is shaped like a crescent so the top and bottom edges of the opening 27, which are also the base 26 of the flared embossment 19 are arced. The bottom edge 28 of the opening 27 lies level with the top surface 9 of the bottom chord 7, and the downwardly arcing edge 26 of the opening 27 lies at an angle to the seat 4 of the joist hanger 1. This particular form is the preferred form of the invention, for use with an I-Joist 2.

In a similar form, shown in FIGS. 8-14, the embossment 19 does not bulge outward above the opening 27. Instead, the embossment 19 and the opening 27 both taper downward toward the point 24 of the inwardly projecting guide 17 or 18.

In both forms, where an I-joist 2 is used, the point 24 where the embossment 19 projects inwardly the farthest lies just above where the top surface 9 of the bottom chord 7 of the I-Joist 2 would lie when the I-Joist 2 is sitting properly in the joist hanger 1. See FIGS. 2B and 10B.

The dimple or embossment 19 in both forms can take a variety of shapes. As described above, and as shown best in FIG. 3A, preferably the embossment 19 is shaped like a tear drop or a half-cone with the elongated portion disposed above the point 24 where the embossment 19 projects inwardly the farthest.

Shaping the inwardly projecting guides 17 and 18 in this manner aids in the installation of the I-Joist 2, while providing greater resistance to removal of the I-Joist 2. As shown best in FIG. 2A, the relatively gentle narrowing of the space between which the I-Joist 2 must be inserted, when the I-Joist 2 is pushed downwardly from above, means the resistance to the insertion of the I-Joist 2 past the inwardly projecting guides 17 and 18 increases at a relatively slow rate. In contrast, the projecting point 24 of the bottom portion of each guide 17 or 18, as shown in FIGS. 2A, 10A, 6 and 13, means there must be a the force needed to push the I-Joist 2 past the inwardly projecting guides 17 and 18, once it is installed, must be enough to almost completely deform the guides 17 and 18. Thus it is much easier to insert the I-Joist 2 than it is to remove it.

Figure 13:
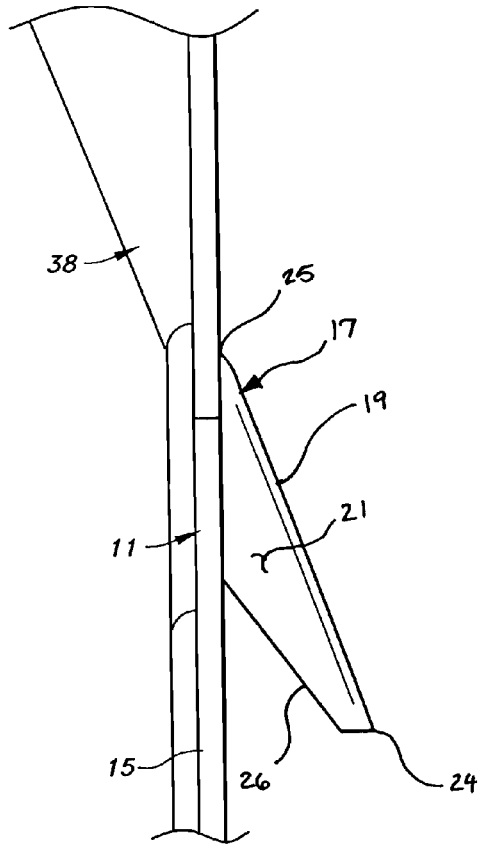
FIG. 13 is an enlarged side elevation view of the side wall of the hanger taken along line 13-13 of FIG. 8, showing one embodiment of the inwardly projecting guide of the present invention.
Figure 14:
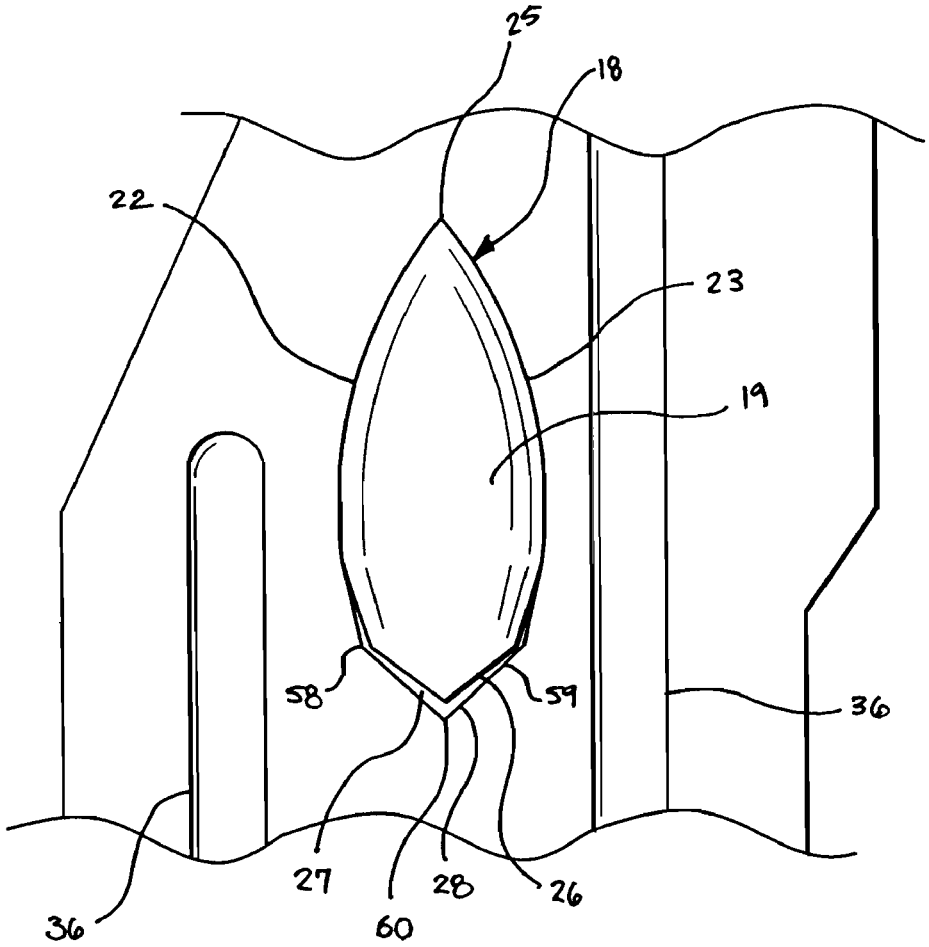
FIG. 14 is an enlarged front elevation view taken along line 14-14 of FIG. 8, showing one embodiment of the inwardly projecting guide of the present invention.

As shown in FIGS. 6 and 13, in the preferred forms of the invention, the portion of the inwardly projecting guide 17 above the point 24 farthest inward falls away gently and at an angle to the side wall 11 of the joist hanger 1 from which the inwardly projecting guide 17 is formed. As described above, this is preferable to a very sharp angle. The long tapering portion above the point 24 farthest inward serves to direct the I-Joist 2 away from the side wall 11 of the hanger, and down onto the center of the seat 4.

As shown in FIGS. 6 and 13, in the preferred forms of the invention, there is no portion of the inwardly projecting guide 17 below the point 24. This is preferable to having the inwardly projecting guide 17 falling away from the point 24 abruptly, such as at a right angle to the side wall 11. This is also preferable to forming a simple tab with a single bend, rather than a stiffening embossment 19, to direct the tip of the tab away from the side wall of the hanger, but still downwardly. Such tabs are shown in U.S. Pat. Nos. 4,411,548 and 5,564,248. These tabs have no portion below the point of the tab where it extends farthest away from the side wall of the hanger, and because they are not embossed, they are relatively weak, both to pressure from above and below.

In the first preferred form of the invention, shown in FIGS. 1-7, the inwardly raised embossed portion 19, which has first and second bracketing transition areas 22 and 23, is wider than the portion of the inwardly projecting guide 17 and 18 that does not have bracketing transition areas 22 and 23. Most preferably, the first and second bracketing transition areas 22 and 23 of the inwardly raised embossed portion 19 diverge toward the opening 27 with a relatively narrow angle between them and then bulge outward away from each other just before the opening 27. The embossment 19 is shallower where this bulging occurs.

In the second preferred form of the present invention, shown in FIGS. 8-14, each inwardly projecting guide 17 and 18 is formed with an opening 27 that has a first edge 58 and a second edge 59. The first and second edges 58 and 59 converge at a plurality of angles from the first and second bracketing transition areas 22 and 23 to a point 60. Preferably, the first and second edges 58 and 59 each have two straight portions, all four straight portions converging to the point 60. This makes a strong sharp point.

Since I-Joists 2 are generally made from wood, the dimensions of the I-Joist 2 can change somewhat due to their relative moisture content. Further, I-Joists 2 from different manufacturers, although designed with the same nominal dimensions will vary in dimension somewhat. The inwardly projecting guide 17 or 18 of the present invention is able to accommodate I-Joists 2 of vary bottom chord 7 dimensions.

The preferred embodiments of the inwardly projecting guides 17 and 18 shown in FIGS. 1-14 are formed primarily by embossing the metal of the side walls 11 and 12. In the two embodiments shown, the side walls 11 and 12 remain completely intact except for the opening 27.

However, while it is preferred to primarily use a single embossment to form the inwardly projecting guides 17 and 18, other operations could be used to form the inwardly projecting guides 17 and 18.

In the preferred forms of the guides 17 and 18, which are formed primarily by embossing and has an opening 27, the point 24 farthest away from the side wall 11 or 12 is fairly sharp, which allows them to cut into the bottom chord 7 of the I-Joist 2 to better restrain it against uplift forces.

The embossing of the inwardly projecting guides 17 and 18 provides strength when the hanger 1 is made out of light gauge steel, as in the preferred form.

As shown in FIGS. 6 and 13, the inwardly projecting guide 17 can also be said to be formed with a compound curve. The inwardly projecting guide 17 is formed so that a first curve at the bracketing transition area of the embossment 22 bends the inwardly projecting guide 17 at angle to the side wall 11 of which it forms a part, and a second curve bends the guide back toward the side wall 11.

In the preferred embodiment show in FIG. 1, when the joist hanger 1 is used with an I-Joist 2, the guides 17 and 18 formed in the side walls 11 and 12 are rigid members. Further, the guides 17 and 18 extend inwardly toward each other such that the guides 17 and 18 create a space between them that is narrower than the width of the I-Joist 2 as defined by the space between the side walls 10 of the bottom chord 7. The guides 17 and 18 do not deflect when the bottom chord 7 of the I-Joist is pressed downward onto the seat 4. Rather the guides 17 and 18 force the side walls 11 and 12 of the joist hanger 1 to flex and bow allowing the bottom chord 7 of the I-Joist 2 to pass by the guides 17 and 18.

In the preferred embodiment for use with an I-Joist 2, the inwardly projecting guides 17 and 18 preferably extend 0.3105 inches inwardly from the side walls 11 and 12 at points 24. The tabs 65 project inwardly 0.165 inches from the side walls 11 and 12. The projection 31 in the seat 4 projects 0.1 inches.

When installing an I-Joist 2, the force with which the side walls 11 and 12 spring back after the bottom chord 7 has bypassed the point 24 at which the guides 17 and 18 project inwardly the farthest, helps to push the I-Joist 2 down on the upwardly extending projection 31 in the seat 4. An alternate embodiment of the upwardly extending projection 31 in the seat 4 is shown in FIG. 2A.

Preferably, no nails are used to attach an I-Joist 2 to the joist hanger 1. This eliminates another opportunity for rubbing to occur between the nail and the I-Joist 2 or between the nail and the joist hanger 1.

The side walls 11 and 12 can also be kept away from the bottom chord 7 of the I-Joist 2 by spacing them from each other a selected distance, such that the only portion of the side walls 11 and 12 that is likely to come into contact with the I-Joist 2 or other type of joist member are the inwardly projecting guides 17 and 18 of the side members 11 and 12.

The joist 2 is formed with substantially parallel opposed side faces 56 defining a first selected width 57 for said joist 2, the opposed side walls 11, 12 of the hanger 1 are substantially planar members 11, 12 disposed in parallel relationship, and spaced from each other a selected distance that is greater than said first selected width 57 of the joist 2, wherein the inwardly projecting guides 17, 18 of the side walls 11, 12 are sufficiently rigid to hold the joist 2 of the first selected width 57 entirely away from the side walls 11, 12 except at the inwardly projecting guides 17, 18, when the side faces 56 of the joist 2 are substantially parallel with the side walls 11, 12 of the hanger 1.

Alternatively, and preferably as shown in FIG. 2*b*, smaller tabs 65 also contact the opposed side faces 56 of the joist 2, holding it away from planar members 11 and 12.

In the preferred embodiment, the bottom chord 7 of the I-Joist 2 is formed with substantially parallel opposed side walls 10 defining a first selected width for the I-Joist 2. These side faces 10 of the bottom chord 7 lie parallel to the side faces 10 of the top chord 6.

In the preferred embodiment, the opposed side walls 11 and 12 of the joist hanger 1 are substantially planar members disposed in parallel relationship, and spaced from each other a selected distance that is greater than the first selected width of the I-Joist 2. See FIG. 2B.

In the preferred embodiment, the inwardly projecting guides 17 and 18 of the side walls 11 and 12 are sufficiently rigid to hold the I-Joist 2 of said first selected width entirely away from the side walls 11 and 12 of the joist hanger 2 except at the inwardly projecting guides 17 and 18, when the side walls 10 of the I-Joist 2 are substantially parallel with the side walls 11 and 12 of the joist hanger 1.

As shown in FIGS. 1 and 2A, to keep the side walls 11 and 12 from bending or warping and coming into contact with the side walls 10 of the I-Joist 2, additional embossments 36 can be formed in the joist hanger 1 to stiffen it. In the preferred form of the joist hanger 1, embossments 36 are formed that start in one side wall 11 run underneath the joist hanger 1 along the seat 4 and then up the other side wall 12. Preferably, the material of the joist hanger 1 is embossed downwardly in the seat 4 and outwardly in the side walls 11 and 12, keeping the material of the hanger away from the I-Joist 2 or other supported member.

As shown in FIGS. 1, 2A, and 2B, preferably, the seat 4 is formed with an upwardly projecting, sharp member 31 for embodiment into the bottom surface 5 of the I-Joist 2. Preferably, the upwardly projecting member 31 or prong is formed out of material of the seat 4.

In the preferred embodiment, an opening 37 is formed by punching the seat 4 in such a manner that the material of the seat 4 is drawn by the punch upward from the seat 4 and out of the plane of the seat 4. As the material is drawn upward, it breaks, causing sharp edges to be formed at the edge of the opening 37. The member 31 formed thereby, is preferably curled 90 degrees out of the seat 4.

Thus, none of the material of the seat 4 is removed from the hanger 1, but rather portions of the seat 4 around the opening 37 are bent out of the plane of the seat. The upwardly-curled, jagged edges of the member 31 have led the inventors to call the preferred form the starburst locator. The jagged edges of the starburst locator 31 grab onto the I-Joist 2 or other member as it is being installed, such that it is fixed in the seat 4.

While the upwardly projecting portion 31 is preferably formed as above, it could also be formed as triangular tab 31' or any number of sharp projecting tabs known in the art.

The inwardly projecting guides 17 and 18 of the side walls 11 and 12, and the upwardly extending member 31 of the seat 4 cooperate during installation to hold the I-Joist 2 away from the side walls 11 and 12, such that it is seated properly, as shown in FIG. 2B. The guides 17 and 18 direct the I-Joist 2 towards the center of the seat 4, and the starburst locator 31 grabs and holds it centered.

As shown in FIG. 1, preferably, the joist hanger 1 is made with back flanges 38, for attaching the joist hanger 1 to the front surface 39 of the header 3. The hanger 1 is preferably attached to the header 3 by means of fasteners 40 driven through the back flanges 38 and into the header 3. The back flanges 38 are preferably provided with openings 41 for facilitating the connection of the hanger 1 to the header 3. Those fasteners 40 are preferably nails, when the header 3 is made out of wood or engineered lumber.

As shown in FIGS. 1-2B and 8-9B, preferably, the back flanges 38 are made out of the same material as the seat 4 and side walls 11 and 12, and are formed by orthogonally bending the back flanges 38 out of each of the side walls 11 or 12. The back flanges 38, preferably, extend outwardly from the outward side faces 15 and 16 of the side walls 11 and 12 of the hanger 1.

In one embodiment, the joist hanger 1 is only attached to the header 3 or support member by means of fasteners 40 that run through the back flanges 38 of the hanger 1 and directly into the header 3. Another way to reduce floor squeak would be to form the hanger 1 such that it has no members or portions that were disposed above the top surface 42 of the header 3, when the hanger 1 is installed.

Joist hangers 1 are broadly classified into four categories, face-mount hangers, top-flange hangers, wrap-around hangers and saddle hangers, depending, primarily, on how they are attached to the header 3. The improvements of the present invention relating to the inwardly projecting guides 17 and 18 and the positioning of the I-Joist 2 can be used with all types of joist hangers 1.

Figures 15, 16:
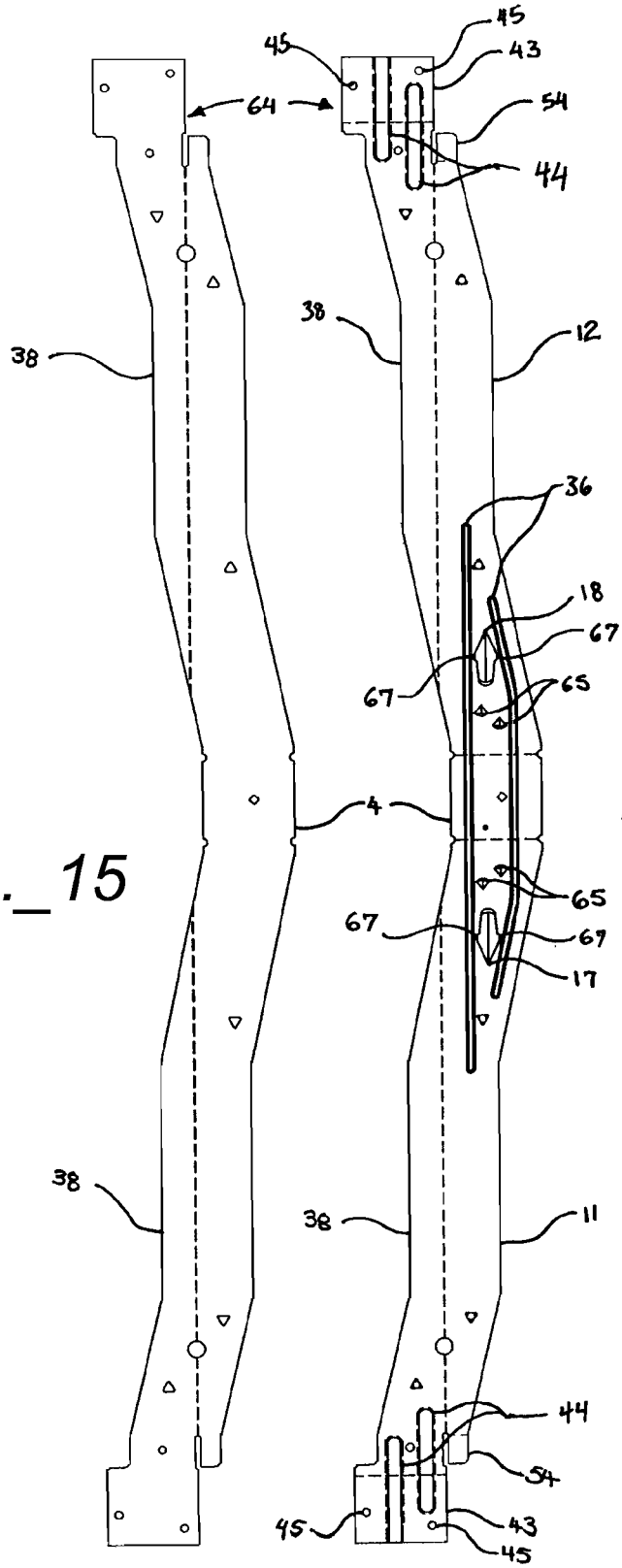
FIG. 15 is a top plan view of the blank of the hanger of the present invention, prior to embossment.
FIG. 16 is a top plan view of the blank of the hanger of the present invention, after embossment.

Top flange hangers add a top flange 43 member to the typical face-mount hanger, this top flange 43 is formed to engage the top surface 42 of the header 3, such that the hanger 1 can hang from the header 3. A hanger with typical top flanges 43 is shown in FIG. 1. Top flange 43 has a bend line 49. The top flanges, as shown in FIG. 16, are formed with embossments 44 for strengthening the top flanges 43 and with openings 45 for receiving fasteners. With most top-flange hangers 43, fasteners are used to attach the hanger 1 to both the front surface 39 of the header 3 and the top surface 42 of the header 3 through the top flange 43. Generally, less nails are driven into the front surface 39 of the header 3 with top-flange hangers than with face-mount hangers, because the top flange 43 can provide most of the support for the hanger 1.

Wrap-around hangers are similar to top-flange hangers. They add another member to the top flange that engages the back surface of the header, to make an even stronger connection. Saddle hangers consist of two joist receiving members that are connected by a member that wraps over the top of a header.

The joist hanger 1 of the present invention can be formed with top flanges 43 that hook over the top of the header 3; however, the inventors have found that squeaking in the connection can be lessened if no top flanges 43 are present. Top-flange hangers generally rely substantially on the top flange 43 hooked over the top surface 42 of the header 3 to carry the load. The inventors have found that top-flange hangers, having only a few nails in the back flanges near the top of the hangers, tend to stretch over time. This stretching is partly a result of the top flange digging into the header or rounding off the edge of the header. This stretching is also due to the straightening of the bend in the top flange and back flanges. This stretching creates looseness in the connection that can lead to excess noise.

Furthermore, as shown in the Callies '248 and the Tschan '548 patents, with typical top flange hangers, the distance between the lowest nail in the back flange and the seat is quite far. This distance between the seat and the lowest anchor point of the hanger in the header allows the seat of the hanger quite a bit of play to pull away from the front surface of the header under load. This can also lead to squeaking.

In the present invention, by driving a plurality of spaced fasteners 40 through the back flanges 38 into the front surface 39 of the header 3, the opportunity for the hanger 1 or portions of the hanger 1 to stretch under load is reduced. See FIG. 2A. Reducing stretching of the hanger 1 also helps to eliminate squeaks caused by parts rubbing. The lowest fastener 40, preferably, attaches the back flange 38 to the header 3 at a point that is at least halfway down the length of the hanger 1 from the highest point of the hanger 1. Typically, the highest point of the hanger 1, is either top end 62 of a back flange 38 or the top end 61 of a side wall (11, 12).

However, the inventors have also found that with the preferred rigid, inward-projecting guides 17 and 18, the lowest fastener 40 in the back flange 38 cannot be too close to the seat 4. See FIG. 2A. This is because if the fastener 40 is too close it will interfere too greatly with the ability of the side walls 11 and 12 to flex outwardly, making it too difficult to push the I-Joist 2 onto the seat past the guides 17 and 18.

Another reason for removing the top flange is that top flanges generally lift the floor sheathing away from the top surface of the header. The inventors have found that a problem with the prior art is that using nails to attach the top flange of the hanger to the header lifts the floor sheathing or sub-flooring even higher above the surface of the header. This creates gaps or space between the top surface of the header and the bottom surface of the floor sheathing. Forming the floor with these gaps can lead to looseness of fit over time and rubbing of parts as the building settles. Using relatively green lumber further exacerbates this problem.

However, installers like to use hangers with top flanges, and the inventors have found a way to accommodate the needs of the installers with the needs to produce floors with minimal squeak.

Figure 8:
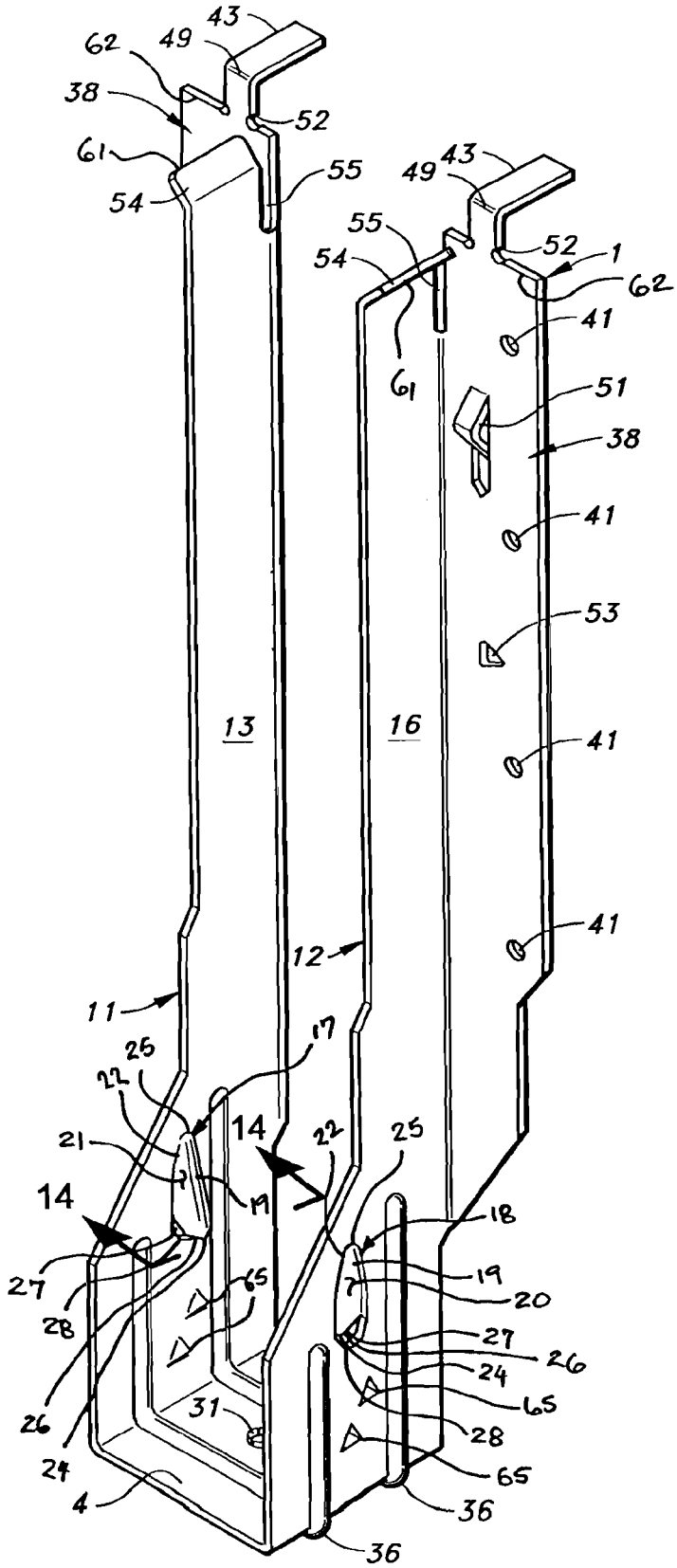
FIG. 8 is an isometric view of a joist hanger of the present invention.
Figure 9A:
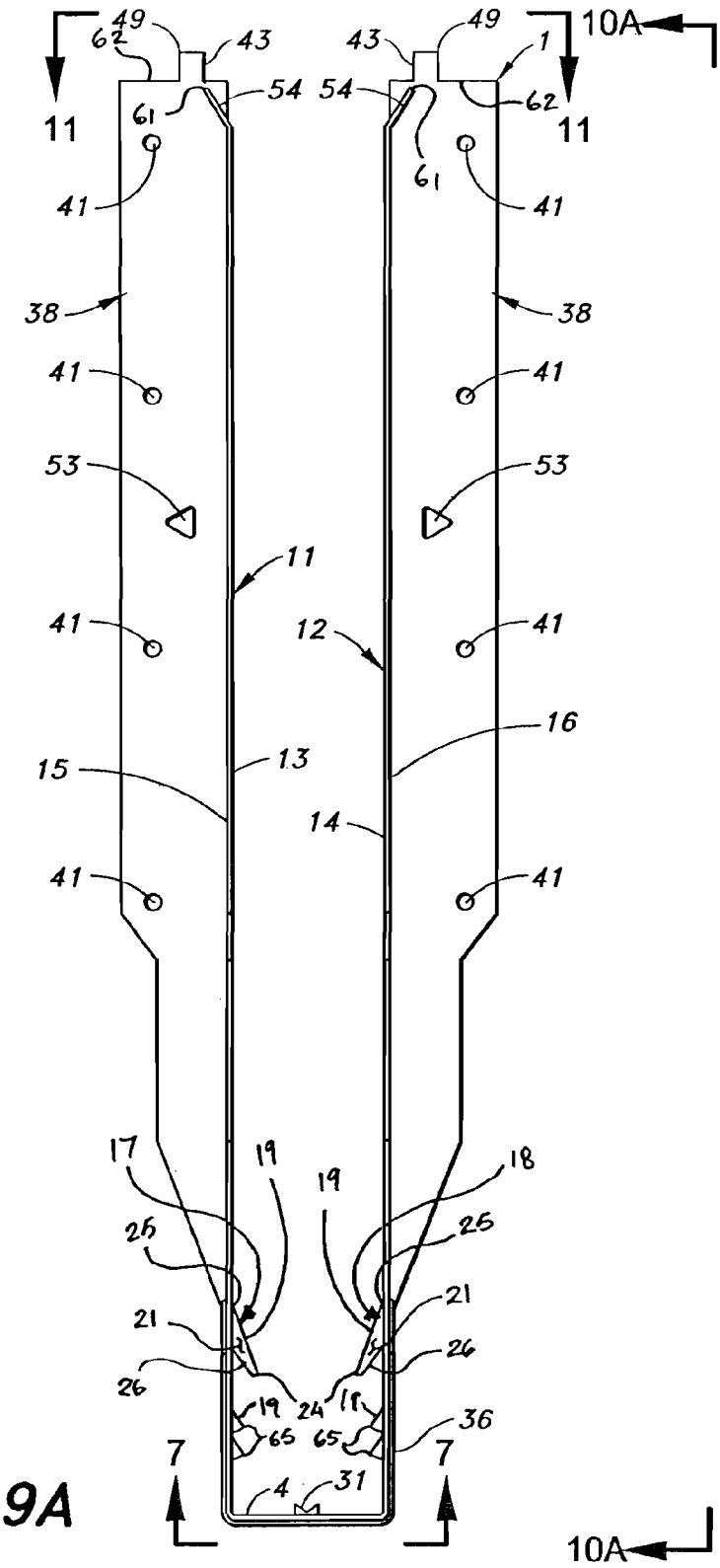
FIG. 9A is a front view of a joist hanger of the present invention.
Figure 9B:
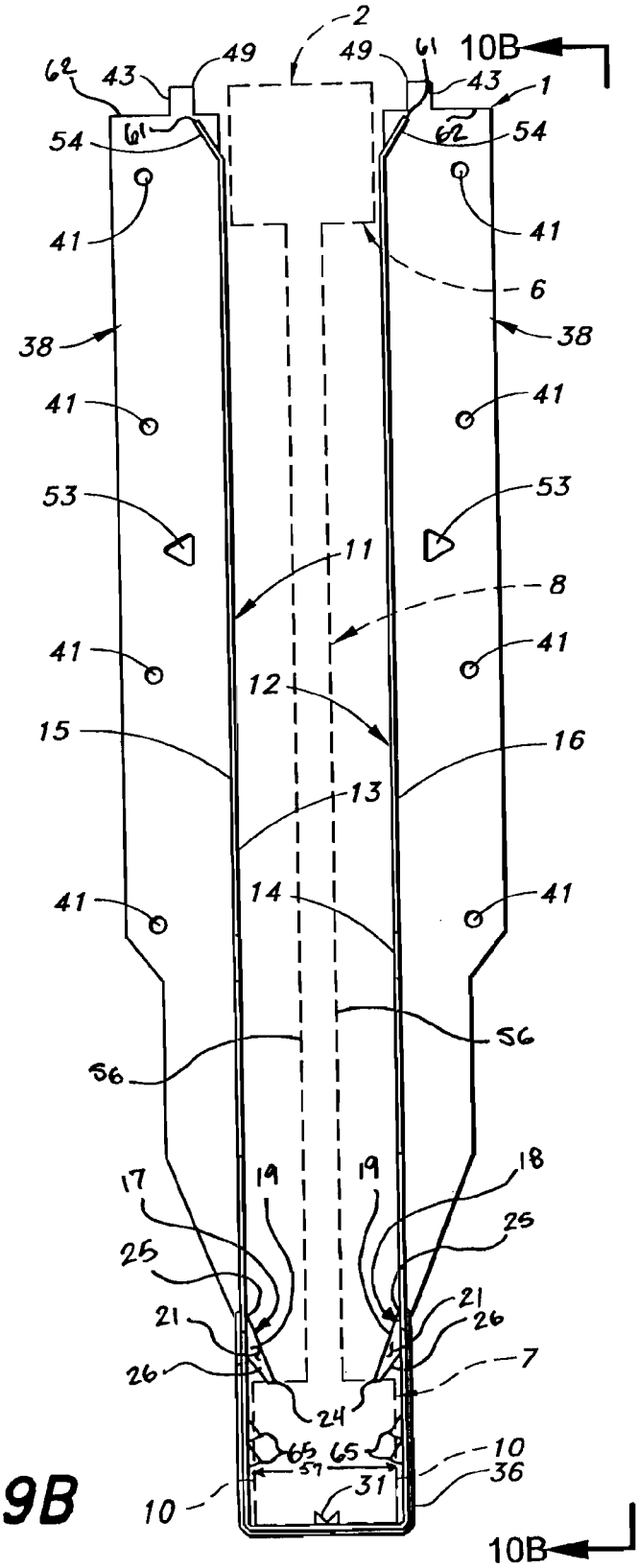
FIG. 9B is a front view of a joist hanger of the present invention. An I-Joist, shown in phantom lines, is received by the joist hanger
Figure 10A:
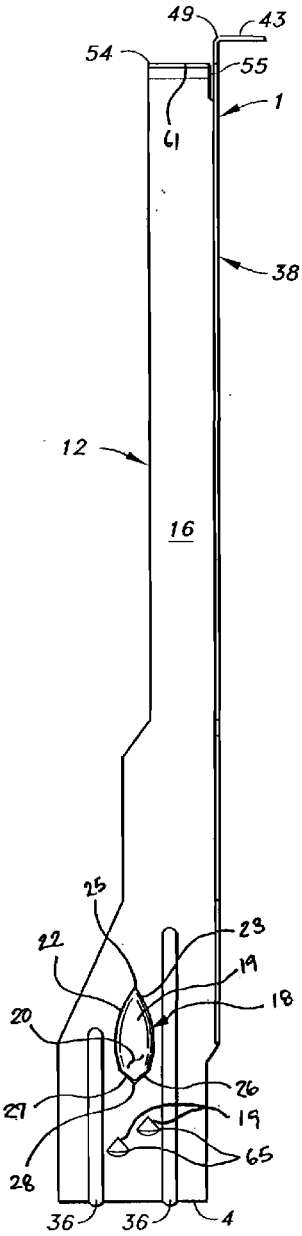
FIG. 10A is a side view of the joist hanger of FIG. 2A, taken along line 3A-3A.
Figure 10B:
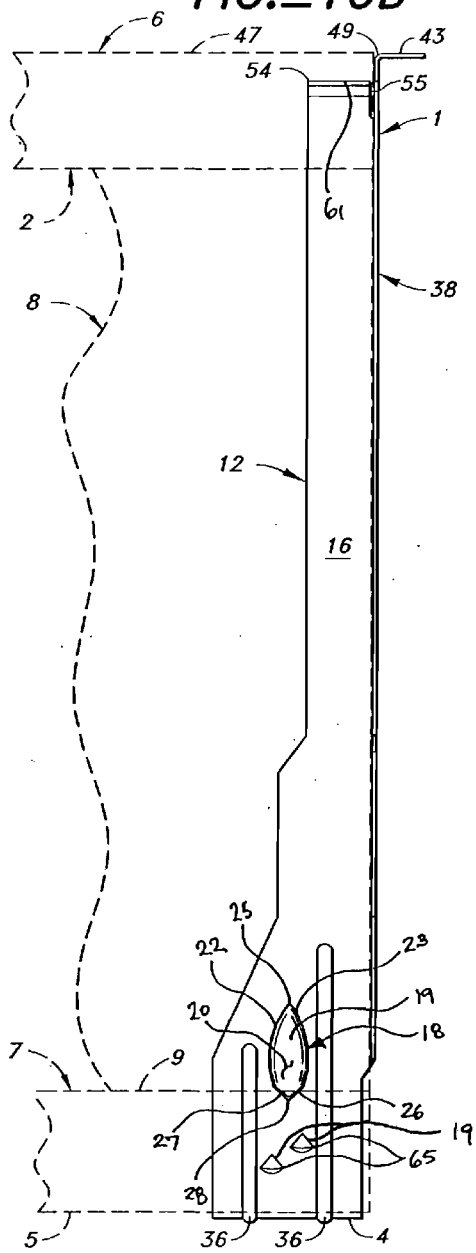
FIG. 10B is a side view of the joist hanger of FIG. 2B, taken along line 3B-3B.
Figure 11:
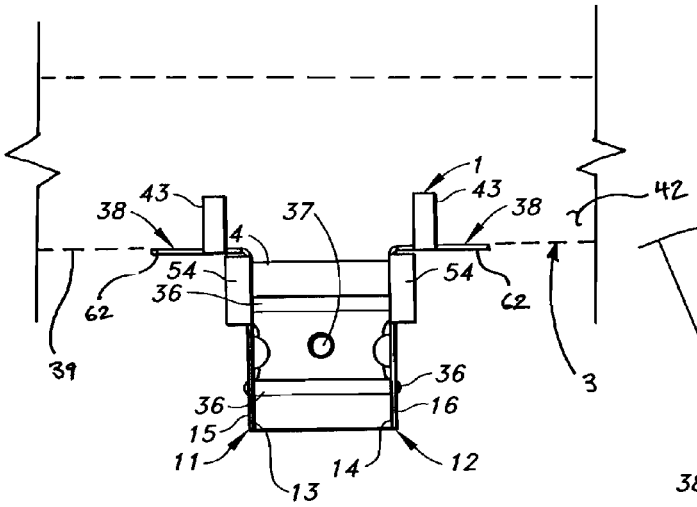
FIG. 11 is a top view of the joist hanger of FIG. 2A, taken along line 4-4.
Figure 12:
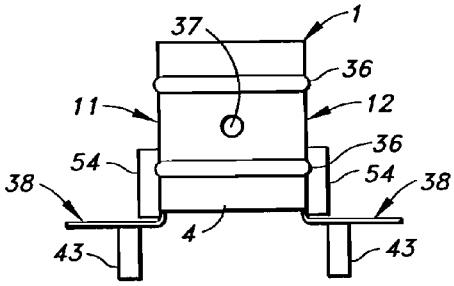
FIG. 12 is a bottom view of the joist hanger of FIG. 2A, taken along line 5-5.

As shown in FIG. 8, top flanges 43 are useful during installation, because that hook onto the top surface 42 of the header 3, allowing the installer to hang the hanger 1 off the header 3 before he permanently attaches it with nails 40 or other fasteners. This makes it easier to install the hanger 1, because if the proper joist hanger 1 is selected for the particular I-Joist 2 or other member, just by hanging the hanger 1 from the header 3, the seat 4 of the hanger 1 is set at the proper elevation for receiving the I-Joist 2. Further, the hanger 1 holds itself at the correct elevation, while the installer permanently attaches it to the header 3 with fasteners 40.

Recognizing this, the inventors have adopted a compromise solution by providing low-profile, top flanges 43 on the hanger 1 that are relatively thin and narrow, such that in some situations they can actually be pushed into and become flush with the top surface 42 of the header. See FIG. 2*b*. In this embodiment, preferably, no embossments are formed in the top flanges 43. See FIG. 2*b*, where narrow top flanges 43 are shown that are so thin that they are pushed into the top surface 42 of the header 3, such that the sub-flooring 46 can be fully supported by the top surface 42 of the header 3 and the top surface 47 of the top chord 6 of the I-Joist 2. Nails 48 are shown attaching the sub-flooring 46 to the header 3 and I-Joist 2.

The top flanges 43 can be formed so that they are small enough to be pushed into the top surface 42 of headers 3 made from such lumber as Douglas Fir-Larch and Southern Pine. In some instances, the top flanges 43 may be pushed into the top surface 42 merely by installation of the sub-flooring 46. The installer could also pound the top flange 43 into the top surface, such that the top flange is flush with the top surface 43 of the header 3. See for example FIG. 2*b*. At the same time, the top flanges 43 are large enough to support the weight of the hanger 1 while the installer is attaching it to the header 3.

The dimensions of the top flanges 43 or self-jigging tabs is dependent on a combination of factors, including the strength and thickness of the material from which the hanger 1 is made. As stronger materials are used to make the hanger 1 and the top flanges 43, the top flanges 43 can be made smaller.

If desired, nail prongs could be added to the top flanges 43. These nail prongs could be used to more securely fasten the hanger 1 to the header 3 while the joist hanger 1 is being connected to the header 3 with nails 40 or other fasteners. The nail prongs would be formed out of the metal of the top flanges 43. The nail prongs would be driven into the header by striking them with a hammer.

Nail prongs 51 can be added to the back flanges 38 of the hanger 1. See FIG. 1. These nail prongs 51 help to more securely fasten the joist hanger 1 to the header 3 before the nails 40 or other fasteners are driven into the header 3.

In some embodiments of the invention, after the joist hanger 1 has been attached to the header 3, the top flanges 43 can be bent away from the top surface 42 of the header 3 so that no portion of the hanger 1 extends above the top surface 42 of the header 3. The top flanges 43 could be bent back with a screw driver or pliers, or even removed. If this is done, the top surface 42 of the header 3 is uncovered, presenting a completely flat surface for the installation of the sub-flooring 46 or other spanning members. The inventors realize that installers are usually time pressured and may not take the time to bend the top flanges 43 back.

Notches 52 as shown in FIG. 1 can also be made to allow the installer to easily break-off the top flange. This feature also benefits the installer, if she chooses to set the joist hanger 1 at a different elevation on the header 3 then that provided by the self-jigging top flanges 43.

In the preferred embodiment, the back flanges 38 are formed with triangle-shaped openings 53 to indicate that extra fasteners may be added where additional loading of the joist hanger 1 is expected.

In the preferred embodiment, at the tops of the side walls 11 and 12 of the joist hanger 1, upper bend tabs 54 are formed that help guide the I-Joist 2 between the side walls 11 and 12. The upper tabs 54 at the tops of the side walls 11 and 12 flare outwardly to form a funnel for receiving the bottom 5 of the I-Joist 2.

In the preferred form, notches 55 are made between the bend tabs 54 and the back flanges 38 and portions of the side walls 11 and 12 and the back flanges 38 to allow the bend tabs 54 to more easily give, making it easier to initially slip the I-Joist 2 into the joist hanger 1 at a skewed angle.

In the preferred form of the invention, the seat 4 of the joist hanger 1 is 2 inches deep to provide an appropriate bearing surface for a typical light-frame I-Joist 2.

Preferably, the joist hanger 1 is constructed in a manner that allows it to be produced from a single strip of light gauge sheet metal bent and embossed at appropriate locations to form the completed joist hanger 1. This process is preferably accomplished on an automated, progressive die.

Preferably, the joist hangers 1 are die-formed from No. 18 gauge galvanized steel. The galvanizing and steel comply with ASTM A 653-97, G 60 specification or better. The steel has a minimum yield strength of 28,000 psi or better and a minimum tensile strength of 38,000 psi or better.

In use, the joist hanger 1 is mounted on the header 3 by appropriate fasteners 40. In light frame wood construction this would generally be nails 40 driven through openings 41 provided in the back flanges 38 for attaching the joist hanger 1 to the header 3. Thereafter, the I-Joist 2 is simply pressed into place onto the seat 4 and between the side walls 11 and 12 and the guides 17 and 18 on the side walls 11 and 12.

If the joist 32 is made from solid-sawn lumber, it will generally need to be further fastened to the joist hanger 1 for resisting uplift forces by appropriate fasteners 35. Again, in light frame wood construction, these would generally be nails 35 or screws. Again, openings 34 would generally be provided in the guides 17 and 18 to make this attachment more easily.

In the preferred embodiment, the joist hanger 1 is used to secure an I-Joist 2 to a solid-sawn wood header 3. The joist hanger 1 is first positioned on the header 3 by selecting where along the header 3 the I-Joist 2 is to be set and then hooking the top flanges 43 of the joist hanger 1 onto the top surface 42 of the header 3. The nail prongs 51 are then driven into the front surface 39 of the header 3. Nails 40 are then driven through openings 41 provided in the back flanges 38 of the joist hanger 1 and into the header 3.

Thereafter, the I-Joist 2 is pressed onto the seat 4. As the bottom chord 7 of the I-Joist 2 passes by the guides 17 and 18 in the side walls 11 and 12, the side walls 10 of the bottom chord 7 push on the guides 17 and 18, and the guides 17 and 18 push the side walls 11 and 12 outward, allowing passage of the bottom chord 7. When the upper surface 9 of the bottom chord 7 passes by the points 24 on the guides 17 and 18 where they extend inwardly the farthest, the side walls 11 and 12 of the hanger 1 spring back inwardly toward each other. The points 24 of the guides 17 and 18 push on the top surface 9 and the edge between the top surface 9 and side walls 10 of the bottom chord 7, which in turn pushes the bottom surface 5 of the bottom chord 7 onto the seat 4 and the upward projection 31 of the seat 4. This spring-action has led the inventors to refer to the joist hanger 1 as a snap-in hanger. The connection of the I-joist 2 to the joist hanger 1 is then complete. Subflooring 46 or other materials to finish the floor diaphragm are then added.

During the making of the preferred connection of the present invention no nails are driven into the I-Joist 2.

Preferably, the joist hanger 1 is attached to the header 3 with 10 d common nails.

The joist hangers 1 are preferably intended for use in conjunction with I-Joists 2. The I-Joist 2 is preferably made with either laminated veneer lumber top and bottom chords, dimension lumber flanges or laminated strand lumber top and bottom chords.

The preferred I-Joists 2 manufactured by Trust Joist MacMillan Corporation, include model numbers TJI®/Pro™ 150, 250, 350, representing different sizes. The dimensions of the joist hanger 1 are modified to accommodate each different model of I-Joist listed above.

The header 3 is preferably made from Douglas Fir-Larch or Southern Pine lumber or structural composite lumber.

The preferred form of the present invention has been described in terms of a standard joist hanger 1 wherein the seat 4 lies at what is substantially a right angle to the front surface 39 of the header 3, and the side walls 11 and 12 also lie orthogonally to both the seat 4 and the front surface 39 of the header 3. However, the formations of the present invention have application also in slope and skew hangers.

The most preferred embodiment of the blank 64 of the present invention are shown in FIGS. 15 and 16, which show one of four preferred sizes of the same joist hanger 1. All four sizes are preferably made from 18-gauge GR33 G90 pre-galvanized steel. All four preferably include a pair of diagonally offset tabs 65 between the guides 17 and 18 and the seat 4.

The pair of diagonally offset tabs 65 provide additional restraint against upward forces.

All four sizes of the most preferred embodiment include a pair of strengthening embossments 36 that traverse the seat 4 from the first opposed side wall 11 to the second opposed side wall 12, both continuing farther up the side walls 11 and 12 than the guides 17 and 18. The embossment 36 closer to the back flange 38 is preferably longer than the other embossment 36, and is preferably straight, while the other embossment 36 is shorter and preferably angled in the side walls 11 and 12. The embossments 36 are preferably embossed down 1 times the metal thickness. In all four of the most preferred embodiments, the first and second opposed side walls 11 and 12 are preferably bent up at 90 degrees from the seat 4, and the back flanges 38 are bent down at 90 degrees from the side walls 11 and 12. In all four of the most preferred embodiments, there is an additional pair of strengthening embossments 66 that run from the side walls 11 and 12 into each of the top flanges 43. These embossments 66 are preferably embossed down 0.75 times the metal thickness. Finally, in all four of the most preferred embodiments, the upper bend tabs 54 for funneling the joist 2 are bent down 30 degrees from the side walls 11 and 12. Bend lines are shown broken.

In the largest size of the most preferred embodiment, the seat 4 is preferably 2.4375 inches from the first opposed side wall 11 of the joist hanger 1 to the second opposed side wall 12 of the joist hanger; the first and second opposed side walls 11 and 12 are preferably 15.9688 inches from the seat 4 to the top flanges 43 of the hanger 1; and the top flanges 43, the first and second opposed side walls 11 and 12, and the seat 4 preferably total 37.25 inches. The inwardly projecting guides 17 and 18 are preferably 1.5938 inches from the seat 4.

In the next largest size of the most preferred embodiment, the seat 4 is preferably 3.625 inches from the first opposed side wall 11 of the joist hanger 1 to the second opposed side wall 12 of the joist hanger; the first and second opposed side walls 11 and 12 are preferably 13.9688 inches from the seat 4 to the top flanges 43 of the hanger 1; and the top flanges 43, the first and second opposed side walls 11 and 12, and the seat 4 preferably total 34.4375 inches. The inwardly projecting guides 17 and 18 are preferably 1.5938 inches from the seat 4.

In the third largest size of the most preferred embodiment, the seat 4 is preferably 2.4375 inches from the first opposed side wall 11 of the joist hanger 1 to the second opposed side wall 12 of the joist hanger; the first and second opposed side walls 11 and 12 are preferably 11.8438 inches from the seat 4 to the top flanges 43 of the hanger 1; and the top flanges 43, the first and second opposed side walls 11 and 12, and the seat 4 preferably total 29 inches. The inwardly projecting guides 17 and 18 are preferably 1.5938 inches from the seat 4.

Finally, in the form shown in FIGS. 15 and 16, the seat 4 is preferably 1.875 inches from the first opposed side wall 11 of the joist hanger 1 to the second opposed side wall 12 of the joist hanger; the first and second opposed side walls 11 and 12 are preferably 13.9688 inches from the seat 4 to the top flanges 43 of the hanger 1; and the top flanges 43, the first and second opposed side walls 11 and 12, and the seat 4 preferably total 32.6875 inches. The inwardly projecting guides 17 and 18 are preferably 1.5938 inches from the seat 4.

We claim:

1. A connection utilizing a joist hanger (1), for attaching a joist (2) to a support member (3), said connection comprising:

said joist (2);

said support member (3); and said joist hanger attached to said support member (3), said joist hanger (1) supporting said joist (2), said joist hanger comprising:

a. a seat (4);

b. first and second opposed side walls (11, 12), each of said side walls (11, 12) being attached to said seat (4), each of said side walls (11, 1 2) having an inwardly facing side surface (13, 14) and an outwardly facing side surface (15, 16), said inwardly facing side surfaces (13, 14) facing each other;

c. each of said side walls (11, 12) further having one or more inwardly projecting guides (17, 18) projecting inwardly towards said other opposed side wall (11, 12); and d. each said inwardly projecting guide (17, 18) further being formed with an inwardly raised embossed portion (19), said embossed portion (19) having first and second bracketing transition areas (22, 23) where at least a part of said embossed portion (19) is joined to said side wall (11, 1 2), wherein said inwardly projecting guides (17, 18) are each formed with an opening (27), and said inwardly raised embossed portion (19) bulges outward just above said opening 27, forming two protrusions on either side of said raised embossed portion (19);

e. said side wall (11) further having a plurality of offset tabs (65) between said first guide (17) and said seat (4), said side wall (12) further having a plurality of offset tabs (65) between said second guide (18) and said seat (4), each said offset tab (65) on said side wall (11) being diagonally offset from said other offset tabs (65) on said side wall (11) such that said offset tabs (65) on said side wall (11) are at different levels on said side wall (11), and each said offset tab (65) on said side wall (12) being diagonally offset from said other offset tabs (65) on said side wall (12) such that offset tabs (65) on said side wall (12) are at different levels on said side wall (12);

f. said joist (2) is formed with substantially parallel opposed side faces (56) defining a first selected width (57) for said joist (2) and each offset tab of said plurality of offset tabs (65) further being formed with an inwardly raised non-planar portion (19), said non-planar portion (19) having a plurality of side edges, said non-planar portion (19) being joined to said side wall (11, 12) at said plurality of side edges;

g. said opposed side walls (11, 12) of said hanger (1) are substantially planar members (11, 12) disposed in parallel relationship, and spaced from each other a selected distance that is greater than said first selected width (57) of said joist (2); and wherein h. said inwardly projecting guides (17, 18) of said side walls (11, 12) and said offset tabs (65) hold said joist (2) of said first selected width (57) entirely away from said side walls (11, 1 2) except at said inwardly projecting guides (17, 18) and said paired offset tabs (65), when said side faces (56)) of said joist (2) are substantially parallel with said side walls (11, 12) of said hanger (1).

2. The connection of claim 1, wherein:

said opposed side walls (11, 12) are formed with upper tabs (54) that flare outwardly from said side walls (11, 12).

3. The connection of claim 1, wherein:

one or more embossments (36) are formed in said seat (4) that also extend partially up said side walls (11, 12), said one or more embossments (36) projecting downwardly from said seat (4) and outwardly from said side walls (11, 12).

4. The connection of claim 1, wherein:

said inwardly projecting guides (17, 18) are each formed with a pointed tip (24).

5. The connection of claim 1, wherein:

said opening (27) in said inwardly projecting guide (17, 18) lies adjacent said point (24) farthest away from said side wall (11, 12) of which it is a part.

6. A connection utilizing a joist hanger (1), for attaching a joist (2) to a support member (3), said connection comprising:

said joist (2);

said support member (3); and said joist hanger attached to said support member (3), said joist hanger (1) supporting said joist (2), said joist hanger comprising:

a. a seat (4);

b. first and second opposed side walls (11, 12), each of said side walls (11, 12) being attached to said seat (4), each of said side walls (11, 12) having an inwardly facing side surface (13, 14) and an outwardly facing side surface (15, 16), said inwardly facing side surfaces (13, 14) facing each other;

c. each of said side walls (11, 12) further having one or more inwardly projecting guides (17, 18) projecting inwardly towards said other opposed side wall (11, 12);

d. each said inwardly projecting guide (17, 18) further being formed with an inwardly raised embossed portion (19), said embossed portion (19) having first and second bracketing transition areas (22, 23) where at least a part of said embossed portion (19) is joined to said side wall (11, 12); and e. each said inwardly projecting guide (17, 18) further being formed with an opening (27), said opening (27) having a first edge (58) and a second edge (59), said first and second edges (58, 59) converging at a plurality of angles from said first and second bracketing transition areas (22, 23) to a point (60), wherein said first edge (58) is made up of two or more converging linear portions, with adjacent converging linear portions being connected to each other at a point, and said converging linear portions are set at one or more angles to each other such that they are not collinear or parallel, and said second edge (59) is made up of two or more converging linear portions, with adjacent converging linear portions being connected to each other at a point, and said converging linear portions are set at one or more angles to each other such that they are not collinear or parallel.

7. The connection of claim 6, wherein:

a. said joist (2) is formed with substantially parallel opposed side faces (56) defining a first selected width (57) for said joist (2);

b. said opposed side walls (11, 12) of said hanger (1) are substantially planar members (11, 12) disposed in parallel relationship, and spaced from each other a selected distance that is greater than said first selected width (57) of said joist (2); and wherein c. said inwardly projecting guides (17, 18) of said side walls (11, 12) hold said joist (2) of said first selected width (57) entirely away from said side walls (11, 12) except at said inwardly projecting guides (17, 18), when said side faces (56)) of said joist (2) are substantially parallel with said side walls (11, 12) of said hanger (1).

8. The connection of claim 6, wherein:

said opposed side walls (11, 12) are formed with upper tabs (54) that flare outwardly from said side walls (11, 12).

9. The connection of claim 6, wherein:

one or more embossments (36) are formed in said seat (4) that also extend partially up said side walls (11, 12), said one or more embossments (36) projecting downwardly from said seat (4) and outwardly from said side walls (11, 12).

10. The connection of claim 6, wherein:

said inwardly projecting guides (17, 18) are each formed with a pointed tip (24).

11. The connection of claim 6, wherein:

said side wall (11) further has a plurality of offset tabs (65) between said first guide (17) and said seat (4), said side wall (12) further has a plurality of offset tabs (65) between said second guide (18) and said seat (4), each said offset tab (65) on said side wall (11) being diagonally offset from said other offset tabs (65) on said side wall (11) such that said offset tabs (65) on said side wall (11) are at different levels on said side wall (11), and each said offset tab (65) on said side wall (12) being diagonally offset from said other offset tabs (65) on said side wall (12) such that offset tabs (65) on said side wall (12) are at different levels on said side wall (12).

12. The connection of claim 6, wherein:

said opening (27) in said inwardly projecting guide (17, 18) lies adjacent said point (24) farthest away from said side wall (11, 12) of which it is a part.

13. The connection of claim 11, wherein:

a. said joist (2) is formed with substantially parallel opposed side faces (56) defining a first selected width (57) for said joist (2) and each offset tab of said plurality of offset tabs (65) further being formed with an inwardly raised non-planar portion (19), said non-planar portion (19) having a plurality of side edges, said non-planar portion being joined to said side wall (11,12) at said plurality of side edges;

b. said opposed side walls (11, 12) of said hanger (1) are substantially planar members (11, 12) disposed in parallel relationship, and spaced from each other a selected distance that is greater than said first selected width (57) of said joist (2); and wherein c. said inwardly projecting guides (17, 18) of said side walls (11, 12) and said offset tabs (65) hold said joist (2) of said first selected width (57) entirely away from said side walls (11, 12) except at said inwardly projecting guides (17, 18) and said paired offset tabs (65), when said side faces (56)) of said joist (2) are substantially parallel with said side walls (11, 12) of said hanger (1).

* * * * *